United States Patent [19]

Reed et al.

[11] 4,300,767

[45] Nov. 17, 1981

[54] INFLATED GAME BALL HAVING LONG LASTING PRESSURE RETENTION WITH DECREASED NOISE

[75] Inventors: Thomas F. Reed; Raymond K. Ritzert, both of Akron, Ohio

[73] Assignee: The General Tire & Rubber Company, Akron, Ohio

[21] Appl. No.: 60,316

[22] Filed: Jul. 25, 1979

Related U.S. Application Data

[63] Continuation of Ser. No. 821,002, Aug. 1, 1977, abandoned.

[51] Int. Cl.[3] ..... A63B 41/00

[52] U.S. Cl. ..... 273/61 R; 273/58 F

[58] Field of Search ..... 273/61 R, 61 A, 61 B, 273/61 C, 61 D, 65 ED, DIG. 8, 58 F

[56] References Cited

U.S. PATENT DOCUMENTS

| | | | |
|---|---|---|---|
| 1,402,682 | 1/1922 | Takashima | 273/61 R |
| 3,119,618 | 1/1964 | Molitor et al. | 273/DIG. 8 |
| 3,558,413 | 1/1971 | Wall | 273/61 B X |
| 4,031,688 | 6/1977 | Wasserman | 273/61 D X |
| 4,098,504 | 7/1978 | Koziol | 273/65 ED X |

FOREIGN PATENT DOCUMENTS

| | | | |
|---|---|---|---|
| 2402418 | 7/1974 | Fed. Rep. of Germany | 273/61 D |
| 758471 | 11/1933 | France | 273/58 F |

*Primary Examiner*—George J. Marlo

[57] ABSTRACT

A pressurized game ball including an elastomeric wall defining a cavity containing a compressible inflation gas that includes predetermined mixed amounts of air and a low permeability gas which effectively enables the ball to retain its pressurized state within a desired range of pressures for a period of time significantly longer than the ball would remain pressurized if the inflation gas were air alone with the improvement being that the noise ( a "ping" sound) resulting when an aforesaid gas system is caused to resonate is substantially lessened by including an amount of material sufficient to disturb the sonic resonance in the ball cavity. The best anti-ping material is polyurethane foam, and it may be in the form of a cube weighing less than 0.3 gram.

5 Claims, 7 Drawing Figures

INFLATED GAME BALL HAVING LONG LASTING PRESSURE RETENTION WITH DECREASED NOISE

This is a continuation, of application Ser. No. 821,002 filed Aug. 1, 1977 now abandoned.

BACKGROUND OF THE INVENTION

The present invention generally relates to a ball having an air-permeable elastomeric wall defining a fluid pressurized cavity, or the like that includes as the inflation medium a low permeability gas such as a mixture of air and sulfur hexafluoride ($SF_6$) where the noise resulting from the use of the above inflation medium is ameliorated by including in the ball cavity an amount of material having a configuration such that it is sufficient to disturb its sonic resonance. The invention has been found especially useful and successful when embodied as an improved tennis ball and will herein be described as such.

DESCRIPTION OF THE PRIOR ART

Conventionally, the cavities of rubber articles such as pressurized tennis balls have been inflated with air, although it is also known to use other inflating substances such as nitrogen, ammonia, and the like. However, air has been by far the most commonly used substance because of its ease of use for inflation, its negligible cost and its availability. Although a tennis ball inflated with air initially has satisfactory playability, it ultimately loses some rebound capability since the air permeates the rubber wall or core of the ball and gradually escapes.

This problem of loss of rebound has been solved by the invention disclosed and claimed in U.S. patent application Ser. No. 627,721, now U.S. Pat. No. 4,098,504. In that application an inflation system having improved pressure retention properties is described. The inflation system comprises air and sulfur hexafluoride ($SF_6$).

An undesirable attribute, at least to some, of the use of this inflation system as well as other low permeability systems is that the balls in which they are used produce on impact a noise which may best be described as a "ping." While in no way interfering with the playability of the ball, some find the "ping" distracting or offensive.

In addition to the above-mentioned application, which application is assigned to the assignee of the present invention, a publication describing inflatable articles pressurized with gas systems is U.S. Pat. No. 3,047,040 which discloses the use of several gases for inflating tires and the like to impart a smoother ride to the vehicle. The gases are described as having a "low gamma" of less than about 1.25. Gamma relates exclusively to compressibility and not to permeability. The gases listed include $SF_6$ among several other gases as being a "low gamma" gas. Other low permeability systems to which the present invention has applicability are described in Union of South Africa No. 73/8777, published Jan. 18, 1973, which discloses the use of perfluoropropane gas ($C_3F_8$) and DuPont Freon F-114 ($Cl_2CFCF_3$) to inflate game balls for prolonged pressure retention. $SF_6$ was found to be substantially more suitable in terms of extended pressure retention, material cost or ready availability.

SUMMARY OF THE INVENTION

The object of the present invention to provide in the inflation chamber of pressurized articles such as tennis balls in which the inflation medium consists of a low permeability gas such as sulfur hexafluoride and air, a dampening means to substantially reduce the noise generated in the ball on impact.

The invention will be described in respect of sulfur hexafluoride in the low permeability gas system. It is also useful in respect of other low permeability gas systems such as those containing chloropentafluoroethane, carbon tetrafluoride, perfluoroethane, and perfluoropropane. The term low permeability is intended to be limited to gas systems having a molecular weight* of 49 or more. Gas systems can contain one or more components and refer to the total composition in the ball cavity.

*Molecular weight was obtained by summing the products of the volume fraction and molecular weight of each component in the gas system.

The foregoing and other objects of the present invention are attained in an article of manufacture including an air-permeable elastomeric wall defining a hollow cavity containing a compressible inflation gas of a predetermined amount of air and a predetermined amount of a low permeability gas such as sulfur hexafluoride which is effective to enable the cavity to retain its pressurized state within a desired range of pressures for a period of time lasting significantly longer than the cavity would remain pressurized if the inflation gas were air alone with the improvement that the noise generated in the article on impact is substantially reduced by including in the ball cavity an amount and type of material sufficient to disturb the sonic resonance in the cavity. Such pressurized article may be embodied as a game ball such as a tennis ball.

DESCRIPTION OF A PREFERRED EMBODIMENT

Figure 1:
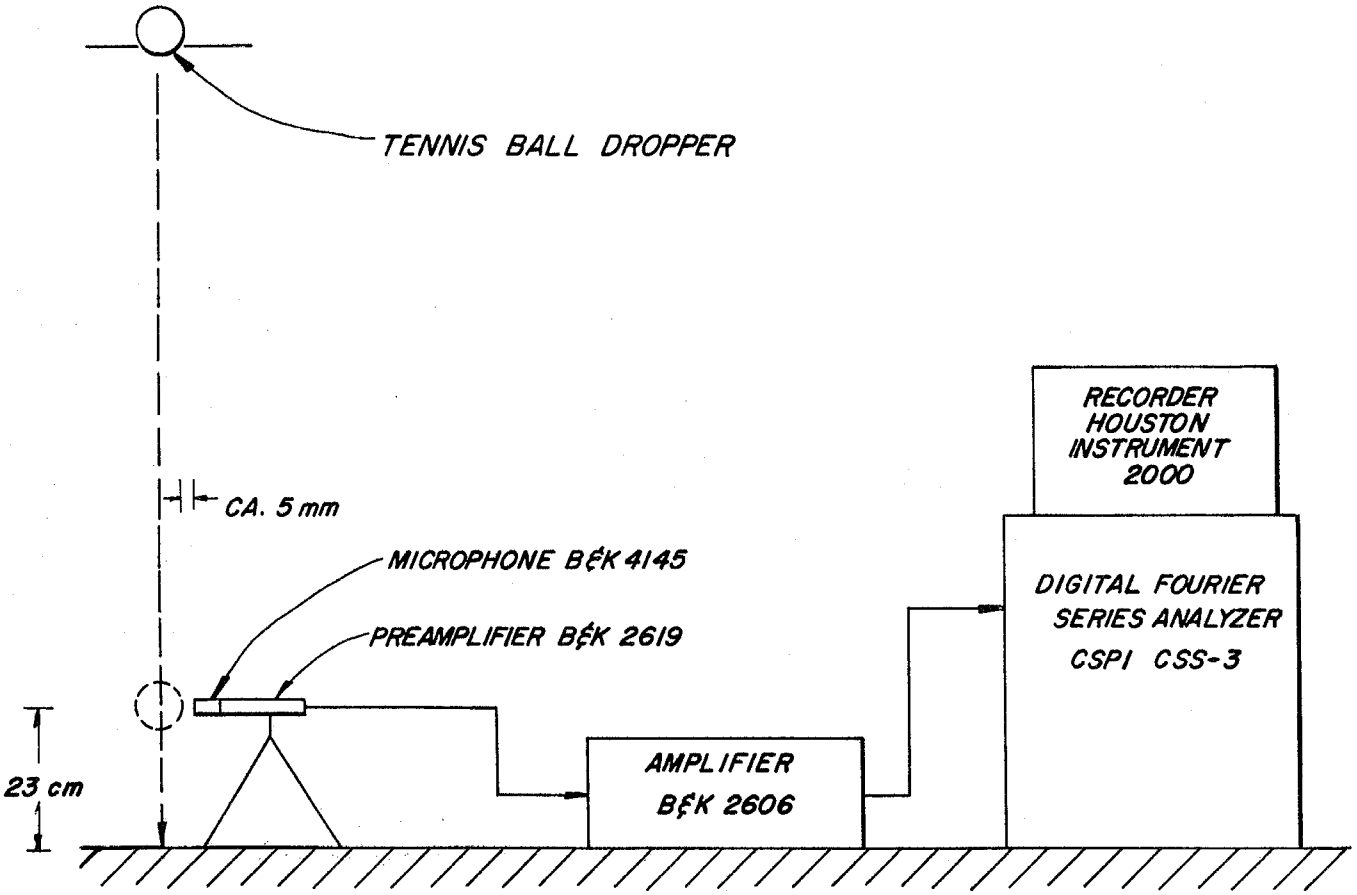
FIG. 1 is a tennis ball sound testing device.

The subject invention is applicable to a game ball having a resilient elastomeric wall defining a hollow cavity which is pressurized and maintained in a pressurized condition with a gas system comprised of one or more gases, at least one of which has a low permeability such as sulfur hexafluoride. The present invention is especially useful in tennis balls wherein the elastomeric wall or core of the ball is made from natural rubber or equivalent elastomeric compounds known in the tennis ball art.

A tennis ball consists essentially of a hollow rubber core covered with felt. The International Lawn Tennis Federation requires that the following specification be met at a temperature of 20° C. and a relative humidity of 60%:

1. Diameter ('go-no-go' gauges), 2.575–2.700 in. (65.4–68.6 mm).
2. Weight, 2—2 1/16 oz. (56.70–58.47 g).
3. Rebound from 100 in. (2.54 m) on to concrete, 53–58 in. (1.35–1.47 m).
4.
   (a) Deformation under 18 lbf (8.2 kgf) load, 0.230–0.290 in. (5.85–7.35 mm).
   (b) Deformation under 18 lbf (8.2 kgf) load on recovery after ball has been compressed through 1 in. (25.4 mm), 0.355–0.425 in. (9–10.8 mm).

The test in 4(*a*) measures the 'compression' or 'hardness' property of the ball, and that in 4(*b*) measures hysteresis after the ball has been compressed through 1 in. (25.4 mm).

A conventional pressure type tennis ball will generally have satisfactory rebound as long as a minimum pressure of about 13 to 15 psi (89.7–103 kPa) gauge or 28 to 30 psi (192–203 kPa) absolute is maintained.

To manufacture tennis balls, one starts with a top grade of natural rubber which is mixed with different chemical ingredients. The mixture is milled to a smooth consistency and fed into an extruder which forms the mixture into pellets, each weighing approximately 27 grams.

The rubber pellets are placed in a multi-cavity precision mold for what is called the first cure process. Under pressure and heat, they are formed into hemispheres or one half of a tennis ball center. These halves are edge-buffed to fine tolerances. Their edges coated with an adhesive, the halves are placed in another mold for the second cure process. This second cure permanently fuses the halves into complete ball centers and provides a controlled interior pressure of 15 psi gauge (103 kPa) within the centers. According to this invention by appropriate alteration of the second cure press, a mixture of air and sulfur hexafluoride may be substituted for the normally used inflation medium air.

The completed centers are conveyed to large buffing machines which abrade the surfaces of the centers. A slightly rough surface permits a ball center to better retain adhesive and result in a good bond between ball and cover. Following buffing, the centers move through a trough-like conveyor in which they are coated with adhesive. They are now ready for covering.

The covers for the balls are cut from felt. The backs of the rolls of felt are coated with adhesive in controlled quantities prior to cutting cover pieces therefrom.

Stacks of the individual cover pieces are placed in special racks which permit them to be dipped in adhesive so that only their edges are coated with the tacky material. These adhesive-coated edges are what become the seams of a tennis ball.

From the covering operation, the tennis balls are moved to another series of presses to undergo a third curing process. This application of heat and pressure assures a solid bond between cover and center. Removed from the curing press, the balls are then placed in a large tumbler in which they are steam-fluffed to raise the nap of the felt and then dried.

These balls are ready for imprinting with brand logos and for packaging. The balls are automatically fed into cans which are hermetically sealed with a pressure of 83 kPa gauge. The pressurized can helps to preserve the balls' freshness until the can is opened and play begins.

Sulfur hexafluoride ($SF_6$) gas mixed with proper proportions of air is an inflation medium which is retained by the elastomeric walls within the cavity at acceptable pressures over a substantially greater period than air.

Tennis balls containing low permeability gases, e.g. sulfur hexafluoride, have an audible "ping" immediately after impact, e.g. a bounce on the floor. The frequency, amplitude and duration of the ping depend on the kind and concentration of the low permeability gas used for inflation. It appears that the frequency of the ping is dependent upon the molecular weight of the gas or gas system and the size of the ball; its amplitude is governed by the dynamic properties of the ball.

Tennis centers were pressurized with the seven gases shown in Table I. The centers were assembled in a second-cure mold using ball halves produced as described above. Centers containing 100 volume percent of the non-air gases were prepared by evacuating the mold as far as possible with a vacuum pump followed by pressurization with the non-air gas to 103 kPa gauge. Centers pressurized only with air and with 50.5 volume percent of the non-air gases were prepared by eliminating the vacuum step in the above cycle. Uniform gas mixtures in the latter groups of balls were insured by using a gas circulator external to the mold.

TABLE I

GASES EVALUATED

| Gas | Name | Source | Purity (%) | $\gamma = Cp/Cv$ |
|---|---|---|---|---|
| $O_2/N_2$ | Air | Laboratory | — | 1.40 |
| $CH_3F$ | Methyl Fluoride | Linde | 99.0 | 1.29 |
| $CHF_3$ | Trifluoromethane | Linde | 98.0 | 1.19 |
| $CF_4$ | Carbontetrafluoride | Linde | 99.7 | 1.16 |
| $CClF_3$ | Trifluorochloromethane | Matheson | 99.0 | 1.15 |
| $SF_6$ | Sulfur Hexafluoride | Linde | 99.0 | 1.09 |
| $C_3F_8$ | Perfluoropropane | Linde | 99.0 | — |

Figure 2:
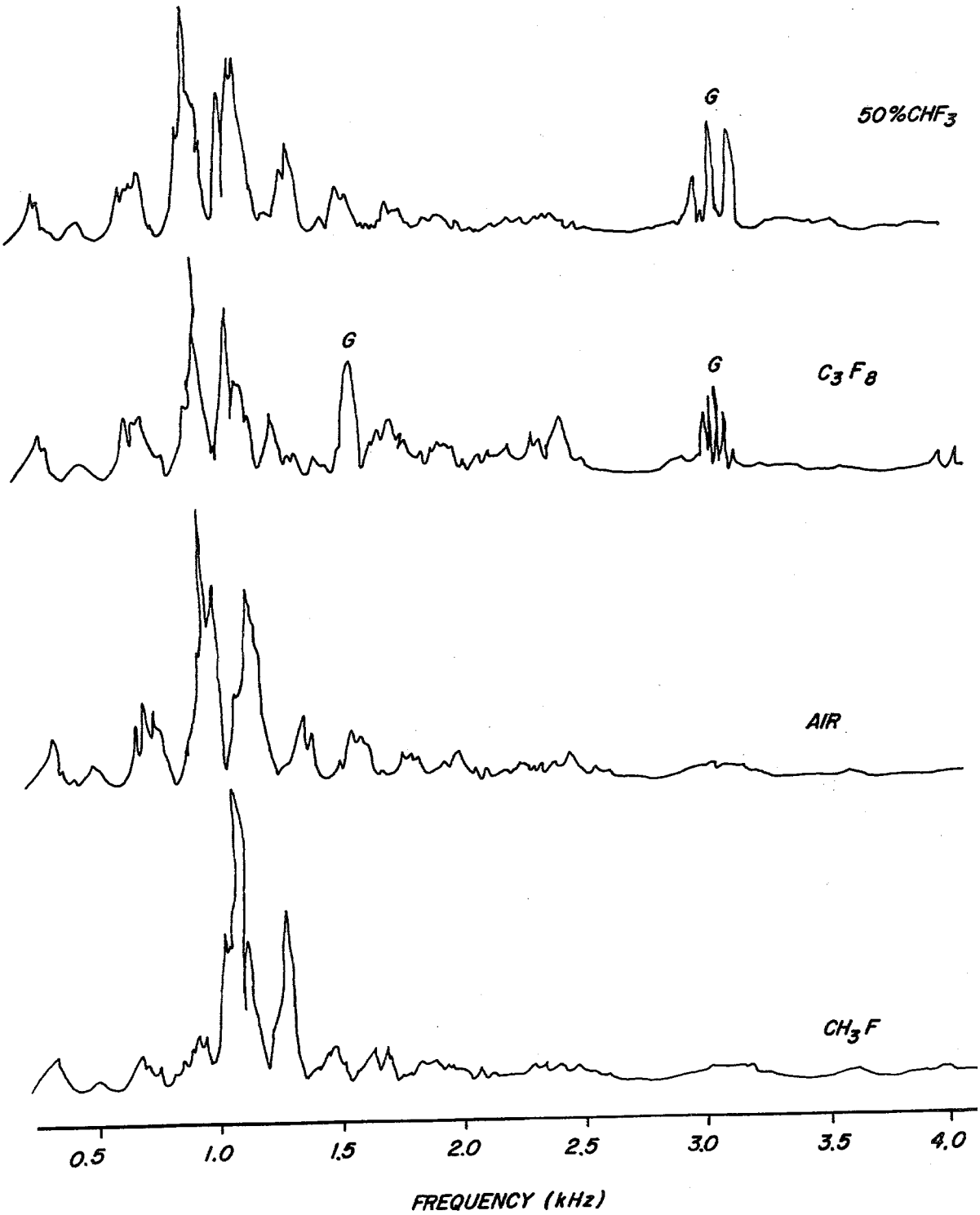
FIG. 2 shows sound frequency graphs for four (4) gases.

Testing of the tennis centers is shown schematically in FIG. 1. The centers were dropped directly on the floor. After the noise from the dropping mechanism subsided but before the center hit the floor, the CSPI Analyzer was turned on to accept the data. The CSPI was triggered by the sound of the center impacting the floor. The data from each test were converted to spectral distributions with the Fourier transformation routines stored in the mini-computer. All spectra were the averages from five individual tests. Examples of the average spectra are shown in FIG. 2 for four gases. These were selected because they are the extremes in molecular weight of the gases that caused pings (50% $CHF_3$ and $C_3F_8$) and those that do not (air and $CH_3F$). The centers containing $SF_6$ are bracketed by the former pair of gases. The absence of peaks in the low frequency ends of the spectra was caused by using a 400 Hz high-pass filter in the CSPI.

Figure 3:
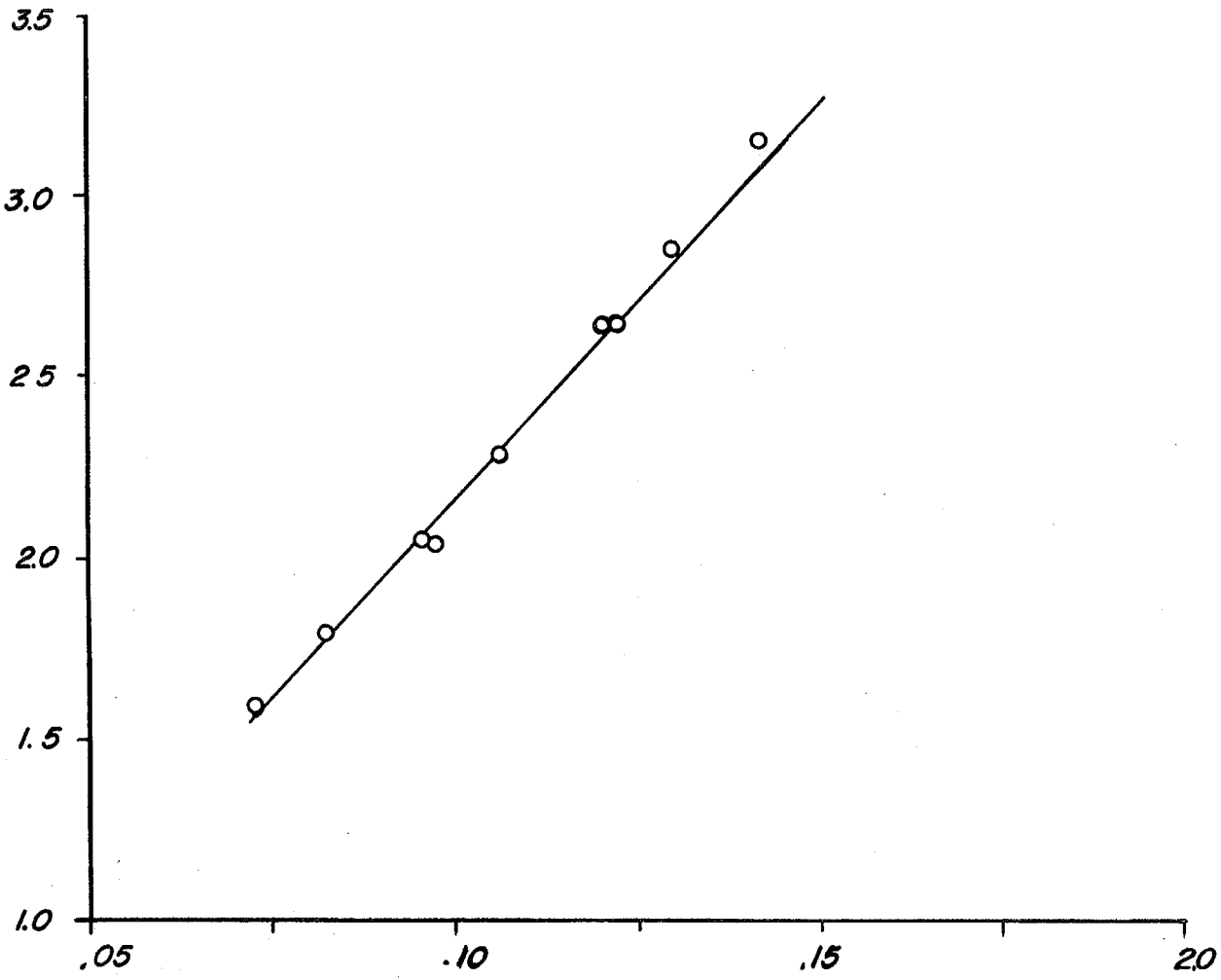
FIG. 3 shows the relation between sound frequency and the gas molecular weight.

Peaks labeled G in FIG. 2 are those attributed to the presence of the gas. The frequencies of these peaks are given in Table II for all gases. Also included are the calculated molecular weights of the gases or gas mixtures and the products of the square roots of these molecular weights and the frequencies of the spectral peaks caused by the gases. The relation between frequency and gas molecular weight is given in FIG. 3. The line was calculated from the relation, $\nu\sqrt{M}=21672$ (Table II) and therefore necessarily passes through the origin. The three centers that had no peaks in their spectra attributed to the gas were also the only ones which had no audible pings.

TABLE II

RESULTS FROM FREQUENCY MEASUREMENTS

| Gas | Concentration[a] (Vol. %) | $\gamma^b$ | Gas MW[b] (g/mol) | Frequency of[c] Gas peak (Hz) | $\nu\sqrt{M^d}$ $sec^{-1}$ $(gm/mol)^{\frac{1}{2}}$ |
|---|---|---|---|---|---|
| Air | 100 | 1.40 | 28.8 | Not Found | — |
| $CH_3F$ | 50.5 | 1.34 | 31.4 | Not Found | — |
| $CH_3F$ | 100 | 1.29 | 34.0 | Not Found | — |
| $CHF_3$ | 50.5 | 1.29 | 49.6 | 3150 | 22185 |
| $CHF_3$ | 100 | 1.19 | 70.0 | 2640 | 22088 |
| $CF_4$ | 50.5 | 1.28 | 58.7 | 2850 | 21836 |
| $CF_4$ | 100 | 1.16 | 88.0 | 2290 | 21482 |
| $CClF_3$ | 50.5 | 1.27 | 67.0 | 2650 | 21691 |
| $CClF_3$ | 100 | 1.15 | 104.0 | 2050 | 20906 |
| $SF_6$ | 50.5 | 1.24 | 88.0 | 2280 | 21388 |
| $SF_6$ | 100 | 1.09 | 146.0 | 1800 | 21749 |
| $C_3F_8$ | 50.5 | — | 109.2 | 2060 | 21527 |
| $C_3F_8$ | 100 | — | 188.0 | 1595 | 21870 |
| | | | | Mean | 21672 |
| | | | | Std. Dev. | 370 |
| | | | | 95% Confidence Level | ±265 |

Figure 4:
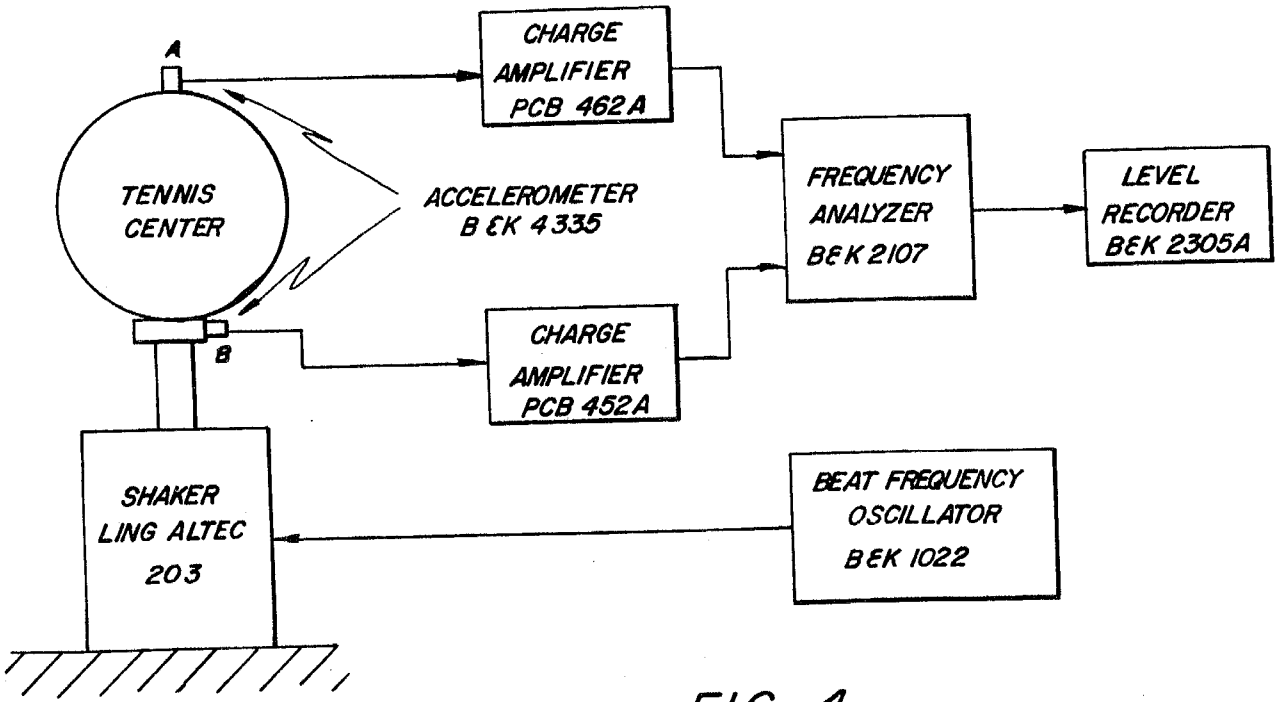
FIG. 4 is a schematic of a sound transmission measuring device.
Figure 5:
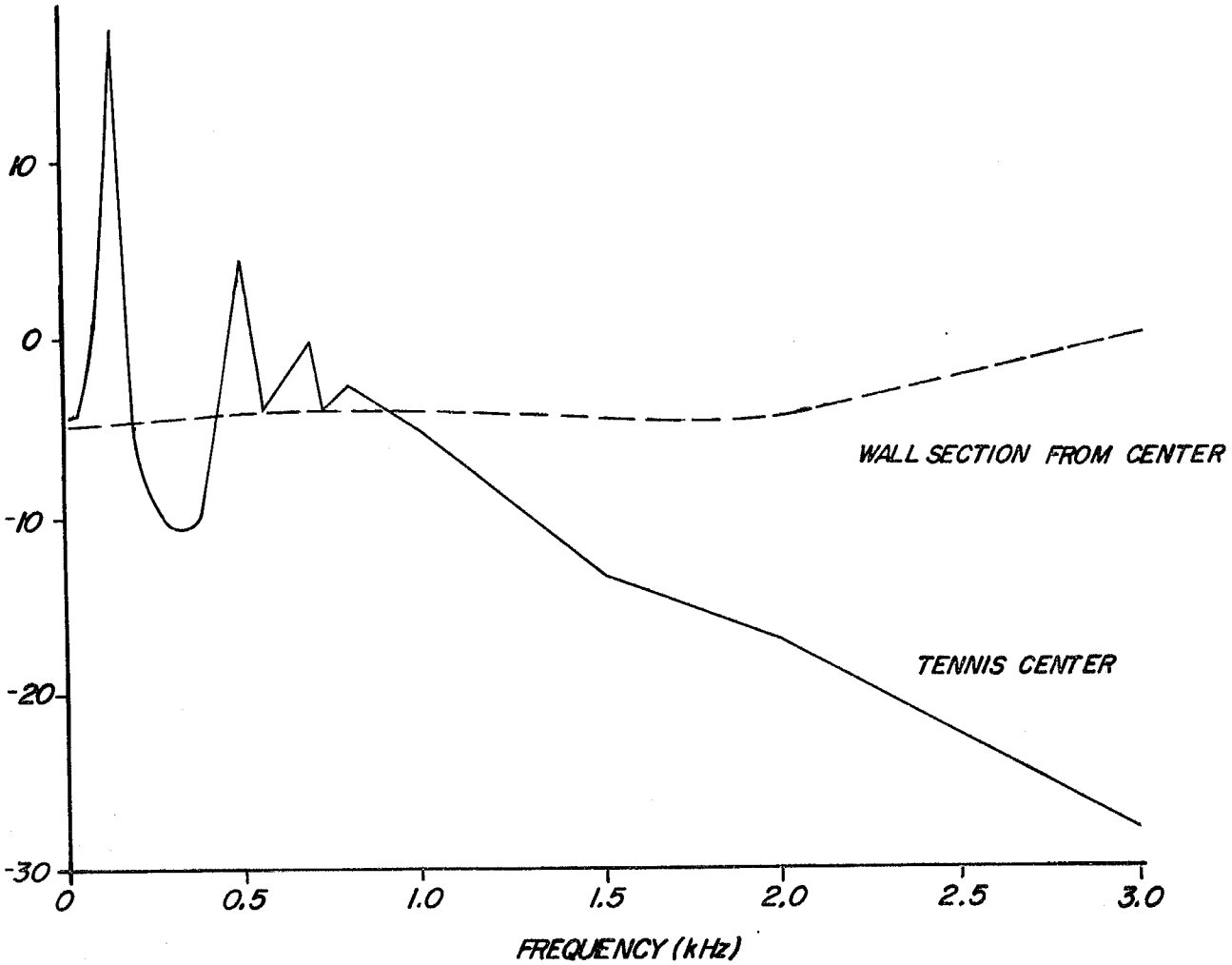
FIG. 5 is a graph showing sound transmission through a tennis center containing air.

Notes:
[a]The other component was air
[b]Calculated weighted average based on composition
[c]In cases with multiple peaks this is frequency of largest
[d]$\nu$ is frequency; M, molecular weight In a second set of experiments, the transmissibilities of tennis centers pressurized with air and with a mixture of air and $SF_6$ were measured between 20 Hz and 10 kHz. The experimental details are shown in FIG. 4, and the result for the center containing air is shown in FIG. 5. Transmissibility is defined as the difference (in dB) between the output and input accelerometers, i.e. (A–B) in FIG. 4. The transmissibility curve for the ball containing $SF_6$ was essentially the same as that from the ball pressurized only with air; the $SF_6$ center had a slightly higher transmissibility around 2 kHz possibly attributable to the gas. A piece of the rubber wall from the center originally pressurized only with air was also evaluated. A section ca. 3 cm square was cemented between two aluminum plates. This assembly was mounted in place of the tennis center in FIG. 4 for testing. The results are included in FIG. 5.

Figure 6:
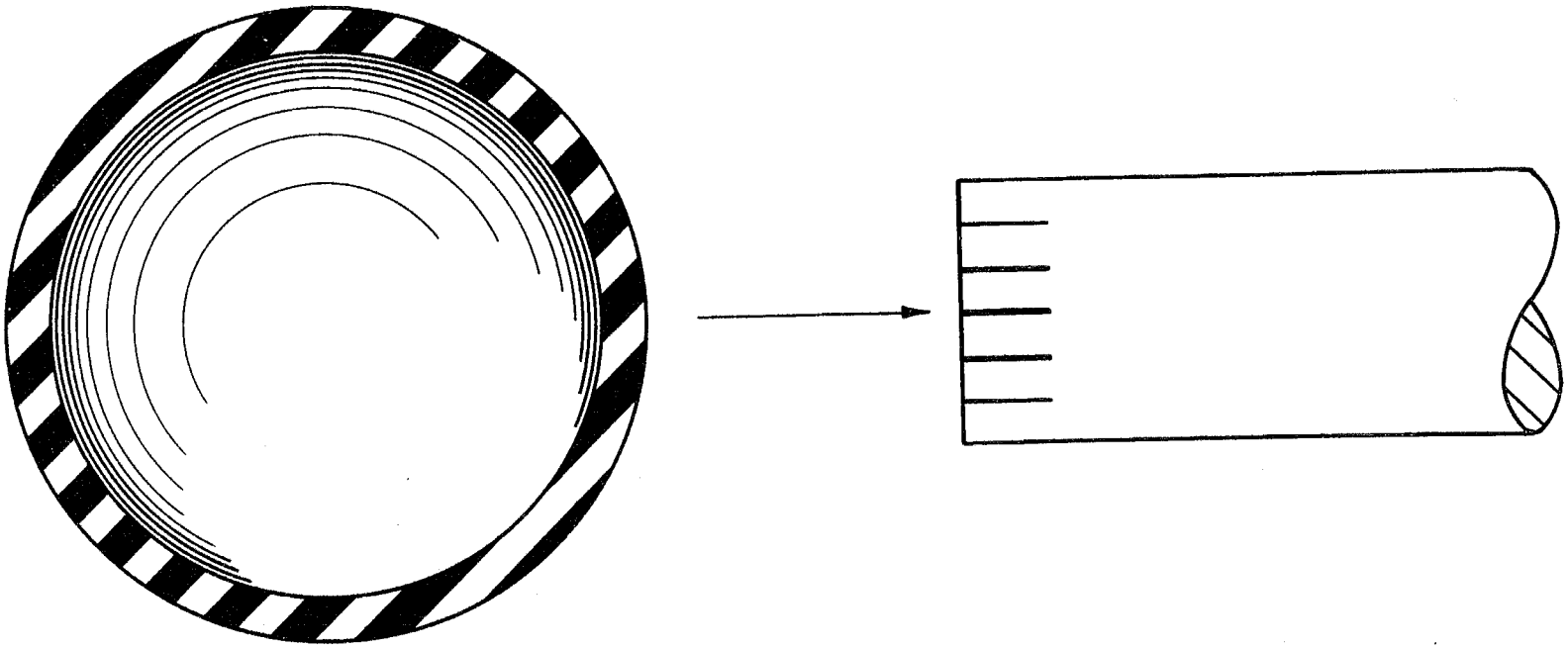
FIG. 6 shows a microphone positioned to pick up sound from a tennis ball.
Figure 7:
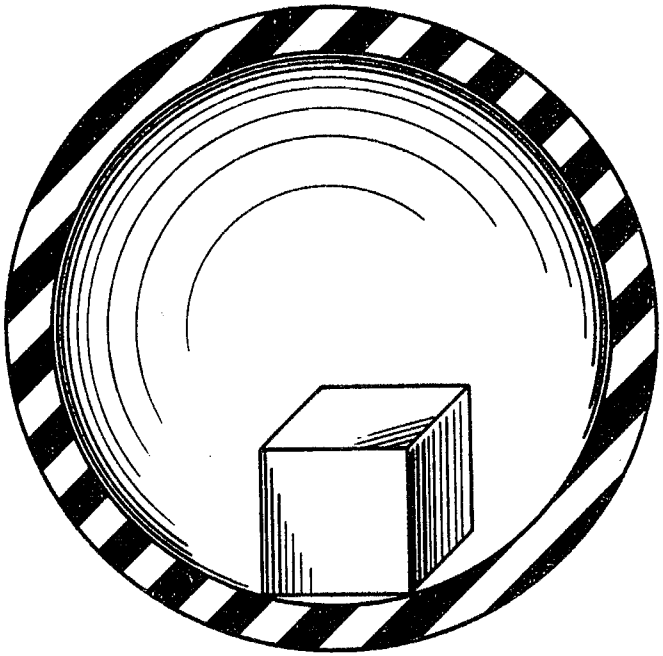
FIG. 7 is a cross-sectional view of a tennis ball showing a sound deadening foam cube inside the ball.

The probable cause of the ping from tennis centers is depicted in FIG. 6. The gas inside the tennis center has specific resonant frequencies governed by the geometry of the cavity and the properties of the gas. An impact of the center excites the gas, and it tries to oscillate at its resonant frequency. This oscillation can only reach the microphone (or a tennis player's ear) if it is transmitted through the rubber. The transmission is not analogous to that experienced by a motor mount, i.e. directly through the solid rubber. Rather, the mode of motion is most probably spheroidal, viz. a vibration in which the spherical structure changes to a spheroid (either prolate or oblate). If the resonant frequency of the gas is the same as the fundamental or a low harmonic of the shell, an appreciable amplitude will be detected by the microphone. A high frequency harmonic has a lower transmissibility, and oscillations of the gas are damped out by the shell and therefore not detected outside.

The spectra in FIG. 2 and the transmissibility data in FIG. 5 appear to confirm this mechanism. Each of the spectra has a set of characteristic peaks between 500 and 2000 Hz which we ascribe to the rubber center. The frequencies and relative amplitudes of these peaks were the same in all centers except the two pressurized with $CH_3F$.

We see relatively large peaks marked G in two of the spectra in FIG. 2. These were observed in all centers which had an audible ping and are attributed to the resonant frequency of the gas in the center. The center containing $C_3F_8$ produces both the fundamental frequency (1595 Hz) and the first harmonic (3200 Hz). The three centers which had no ping (air, $CH_3F$, 50% $CH_3F$) also had responses at these same frequencies, but they were of very small amplitudes. We calculate from the relation in Table II, $\nu\sqrt{M}=21672$, that spectra for these gases should have frequency peaks at 4040, 3720 and 3870 Hz, respectively. No evidence of spectral peaks exists at these frequencies for these three gases.

The transmissibility data in FIG. 5 reveal why the three centers did not ping and also did not have G-peaks in their spectra. Transmissibility at the higher frequencies occurs through the higher modes of vibration of the rubber sphere which are also relatively high energy modes. Extrapolating the curve in FIG. 5 to 3270 Hz (the calculated frequency for $CH_3F$) we find that the output from accelerometer A (FIG. 4) is down approximately 35 dB from the input accelerometer B; stated another way, the ratio of $A/B \simeq 3\times10^{-4}$. The highest frequency that was detected (and heard) was 3150 Hz from the ball containing 50.5% $CHF_3$ (see Table II). From FIG. 5 we see that the transmissibility of the spherical shell at this frequency is estimated to be −29 dB or equal to $1.3\times10^{-3}$; this is about four times that for the ball pressurized with $CH_3F$. The reason we cannot detect a ping in the $CH_3F$ ball is because its vibration is almost completely damped out by the rubber center. The balls containing 50.5% $CH_3F$ or air are expected to have even lower transmissibilities at the higher resonant frequencies of these gases, and their oscillations would be damped even more. It is important to note that the transmissibility of the wall section of the center (referred to above as analogous to a motor mount) is not the important criterion, since it remains essentially flat over the frequency range of this test (FIG. 5). The gas was described in the above mechanism as an oscillator and the source of the ping.

Changes in total gas pressure inside the center should have little effect on the frequency of the ping.

Reduction in ping results from the inclusion of a relatively large structure inside the ball.

A variety of materials were tested for their ability to substantially lessen noise by placing the materials inside the tennis halves, pressurizing them with 100% of a non-air gas and bonding them together in a second-cure mold. The half-centers and cement were from normal production. The non-air gas was one of several which would produce a loud ping (molecular weight greater than 140); a control center containing each type of gas and no other modification was prepared at the same time. The 100% gas concentration was obtained by evacuating the mold and then pressurizing it with the non-air gas. The materials included in the tennis centers are listed in Table III and IV. Those in Table IV are considered less likely to be acceptable in tennis balls for a variety of reasons.

Included in Tables III and IV are semi-quantitative ratings of the degree of ping. These were assessed in individual experiments by listening to the centers as they returned from rapid bounces off the floor. This means of assessment is justified because it was found previously that the ear is as sensitive as the electronic detection of a signal from a microphone pickup of the sound. The compilations in Tables III and IV are assembled from the recorded results of the individual experiments. Hence, there may be some slight variations from the actual values of the numerical ratings, but these are probably inconsequential.

TABLE III

AUDIBLE RATINGS OF TENNIS CENTERS

| Material Added | Shape or Size (cm) | | Weight (gm) | Audible Rating* |
|---|---|---|---|---|
| Foam- | | | | |
| 11 kg/m$^3$ | Cube | 1.2 | 0.038 | 1 |
| 11 kg/m$^3$ | | 0.6 | 0.006 | 2 |
| 16 kg/m$^3$ | | 1.2–3.2 | 0.05–0.63 | 0 |
| 16 kg/m$^3$ | | 0.6 | 0.006 | 3 |
| 24 kg/m$^3$ | | 2.2 | 0.27 | 0 |
| 26 kg/m$^3$ | Sphere | 4.8 | 1.90 | 0 |
| 32 kg/m$^3$ | Cube | 1.2–3.2 | 0.08–1.12 | 0 |
| HiSil 215 | | — | 0.04–0.60 | 0 |
| HiSil 215 | | — | 0.02 | 2 |
| Vermiculite | | — | 0.1 | 0 |

TABLE III-continued

AUDIBLE RATINGS OF TENNIS CENTERS

| Material Added | Shape or Size (cm) | Weight (gm) | Audible Rating* |
|---|---|---|---|
| Vermiculite | — | 0.01–0.05 | 4–3 |
| Rubber Dust | — | 0.35–0.70 | 0 |
| Rubber Dust | — | 0.09–0.18 | 2–1 |
| Soapstone | — | 0.14–2.2 | 0 |
| Soapstone | — | 0.07 | 3.5 |
| Cotton | — | 0.10–0.13 | 0 |
| Cotton | — | 0.02–0.05 | 2–1 |
| Cheesecloth | — | 0.10–0.19 | 0 |
| Cheesecloth | — | 0.05 | 1 |
| Paper - 0.003 cm thick | Wadded | 0.05–0.80 | 0 |
| | Wadded | 0.03 | 1 |
| | Flat Square - 2.9 | 0.05 | 2 |
| | Same - One Fold | 0.05 | 1 |
| | Same - Two Folds | 0.05 | 1 |
| | Same - Wadded | 0.05 | 1 |

*Ratings:
0 = no sound
1 = just audible
4 = equivalent to unmodified ball
A range of ratings corresponds to the range of weights of added materials.

TABLE IV

AUDIBLE RATING OF LESS LIKELY CANDIDATES

| Material Added | Shape or Size (cm) | Weight (gm) | Audible Rating* |
|---|---|---|---|
| Fly Ash | — | 0.15–0.30 | 2–1 |
| Carbon Black-FEF | — | 0.15 | 2(0)** |
| Carbon Black-FEF | — | 0.04–0.08 | 3(2)** |
| Eccospheres | — | 0.35 | 0 |
| Water | — | 1.00–2.50 | 2–1 |
| Ethylene Glycol | — | 1.00–2.50 | 3–2 |
| Tennis Felt | Square 1.3 | 0.21 | 1 |
| Underlay Scrim | Squares 1.3, 6 pcs. | 0.04 | 3 |
| Nylon Rope | 2.5 long, Frayed | 0.08 | 1 |
| Glass Wool | — | 0.09 | 3 |
| Popcorn - Popped | 2 pcs. | 0.60 | 1 |
| Rubber Balloon | 2.8 cm diam. | 1.12 | 0 |
| Cured Rubber | Cube 1.3 | 2.71 | 0 |
| | 0.6 × 0.6 × 5 | 2.71 | 0 |
| | 0.3 × 2.5 × 2.5 | 2.71 | 0 |
| | Cube 0.6 | 0.35 | 2 |
| Drill Rod | 1.2 diam. × 2.5 | 11.75 | 2 |
| Berl Saddles | 2 pcs. | 2.65 | 3 |
| Ball Bearing | 1.2 diam. | 8.35 | 2 |
| Copper Tubing | 0.6 diam. × 1.2 | 1.53 | 3 |
| Copper Tubing | 1.2 diam. × 0.5 | 3.45 | 2 |
| Copper Screen | Formed into 1.2 cube | 1.68 | 1 |
| Styrofoam Peanut | 1.2 diam. × 5 | 0.09 | 4*** |
| Cork | No. 00 | 0.10 | 3 |
| Cork | No. 1 | 0.25 | 2 |

*Same as Table III
**Values in ( ) after vigorous bouncing of tennis center
***Melted and fused into small pellet

TABLE V

RESULTS FROM CENTERS CONTAINING 50.5% $SF_6$

| Anti-Ping Material | Weight (gm) | Center Wt. (gm) | Pressure (kPa) | Diameter (cm) Crown | Diameter (cm) Seam | Deflection (mm) | Rebound % |
|---|---|---|---|---|---|---|---|
| None - control[a] | — | 43.8 | 115 | 6.027 | 6.060 | 7.163 | 65.53 |
| Foam Cube (1.27 cm)[b] | 0.03 | 44.1 | 114 | 6.005 | 6.045 | 7.112 | 65.49 |
| HiSil 215 | 0.04 | 44.5 | 114 | 6.010 | 6.066 | 7.036 | 65.61 |
| Vermiculite | 0.10 | 44.2 | 114 | 6.038 | 6.069 | 7.214 | 65.69 |
| Rubber Dust | 0.30 | 44.4 | 117 | 6.015 | 6.058 | 7.061 | 64.85 |
| Soapstone | 0.14 | 44.2 | 118 | 6.010 | 6.035 | 6.909 | 65.74 |
| Cotton | 0.10 | 44.0 | 117 | 6.017 | 6.043 | 7.036 | 64.20 |
| Cheesecloth | 0.10 | 44.6 | 114 | 6.017 | 6.053 | 7.163 | 63.72 |
| Paper Wad | 0.03 | 44.4 | 116 | 6.020 | 6.058 | 7.087 | 64.88 |

Notes:
[a]Pressurized only with air
[b]Density 16 kg/m$^3$ (1 lb./ft.$^3$)

TABLE VI

RESULTS FROM CENTERS CONTAINING 100% $SF_6$

| Anti-Ping Material | Weight (gm) | Center Wt. (gm) | Pressure (kPa) | Diameter (cm) Crown | Diameter (cm) Seam | Deflection (mm) | Rebound % |
|---|---|---|---|---|---|---|---|
| None - control[a] | — | 43.8 | 115 | 6.027 | 6.060 | 7.163 | 65.53 |
| Foam Cube (1.27 cm)[b] | 0.03 | 44.6 | 117 | 5.999 | 6.035 | 6.960 | 66.26 |
| HiSil 215 | 0.04 | 45.0 | 117 | 6.022 | 6.066 | 7.036 | 63.98 |
| Vermiculite | 0.10 | 44.9 | 118 | 5.992 | 6.033 | 6.858 | 66.23 |
| Rubber Dust | 0.30 | 45.2 | 115 | 6.022 | 6.060 | 7.239 | 65.40 |
| Soapstone | 0.14 | 44.6 | 119 | 6.012 | 6.048 | 7.087 | 65.88 |
| Cotton | 0.10 | 44.6 | 119 | 6.012 | 6.045 | 7.010 | 66.14 |
| Cheesecloth | 0.10 | 45.4 | 117 | 5.999 | 6.040 | 6.985 | 65.45 |
| Paper Wad | 0.03 | 44.4 | 117 | 6.012 | 6.043 | 7.112 | 66.71 |

Notes:
[a]Pressurized only with air; same data as in Table V
[b]Density 16.5 kg/m$^3$ (1 lb./ft.$^3$)

Less than 0.3 gm of any of the materials in Table III is effective and only 1/10 of that is required if the added material is a low density foam. Furthermore, the physical properties of centers containing $SF_6$ and these materials are equivalent to those containing only air. All of the centers containing $SF_6$ are heavier than those pressurized only with air. The additional weight of these balls is caused primarily by replacing air with $SF_6$ (e.g., ca. 0.4 gm calculated for the 50.5% concentration and 0.8 gm for centers containing 100% $SF_6$).

The best anti-ping material that was evaluated is the urethane foam. There are characteristics of foams that are not of concern. Their density makes little difference on their performances as anti-ping materials (Table III); in fact, solid rubber samples of adequate size ($\geqq$1.2 cm cube) are effective (Table IV).

Materials placed inside tennis centers could reduce the ping in two ways; (a) act as absorbers with energy losses in the material and at the interfaces between the material and the gas, or (b) act as reflectors and cause destructive interference of the sound waves within the gas. Although both of these mechanisms probably occur, it can be shown that reflection and the resulting destructive interference most probably predominate. This is caused by the very large difference of acoustic impedances of the gas and added material at their interface ($10^3$–$10^5$). The prominence of this mechanism explains why the properties of any added material have little effect on its efficiency to eliminate the ping. Metals, foam, dense rubber, fibers and powders are all effective in reducing ping if their volumes are large enough. Furthermore, they must be shaped so as to disrupt the spherical symmetry of the inside of the tennis ball. Liquids, for example, are not very effective because they conform to the inside surface of the ball and do not appreciably change the spherical contour. This also explains why folded paper is more effective than unfolded sheets of the same size (Table III). Size of the added material is important; e.g., 1.2 cm cube of foam will prevent ping, whereas an 0.6 cm cube will not (Table III).

The long sonic wavelength is also important. Powders most probably behave collectively as a single large scatter (viz, a cloud) whose density is the average bulk density of the powder-air suspension that exists during a bounce. Note that carbon black (Table IV) was significantly more effective after rapid bouncing; this presumably was caused by breaking up the pellets to form a powder. Liquids under similar circumstances do not have the same effective volume as powders and hence are less efficient.

The foregoing description will suggest other embodiments and variations to those skilled in the art, all of which are intended to be included in the spirit of the invention as herein set forth.

We claim:

1. In a pressurized tennis ball including an elastomeric gas-permeable wall defining a hollow cavity containing a gas system having a molecular weight greater than 49 under pressure, which ball generates noise on impact, the improvement which comprises the addition of a small but effective amount to reduce the noise generated by the presence of the gas system to an audible rating of 1 or less of a solid material having a weight of less than 0.3 grams and shaped to disrupt the spherical symmetry of the inside of the ball, selected from the group consisting of foam, vermiculite, hydrated silica, rubber dust, soapstone, cotton, cheesecloth, one or more hollow spheres, and paper.

2. In a pressurized tennis ball including an elastomeric gas-permeable wall defining a hollow cavity, said cavity containing a gas system having a molecular weight greater than 49 under pressure, which ball generates noise upon impact, which comprises the addition of a small but effective amount to reduce the noise generated by the presence of the gas system to an audible rating of 1 or less of a solid material having a weight of less than 0.3 grams and shaped to disrupt the spherical symmetry of the inside of the ball and sufficient to cause reflection and a resulting destructive interference of the sound waves generated in said cavity when said system is resonated.

3. In a pressurized tennis ball including an elastomeric gas-permeable wall defining a hollow cavity containing a gas system having a molecular weight greater than 49 under pressure which ball generates noise upon impact, the improvement which comprises the addition of a small but effective amount to reduce the noise generated by the presence of the gas system to an audible rating of less than 1 of polyurethane foam having a weight less than 0.3 grams and shaped to disrupt the spherical symmetry of the inside of the ball sufficient to cause reflection and a resulting destructive interference of the sound waves generated in said cavity when said gas system is resonated.

4. In a pressurized tennis ball including an elastomeric gas-permeable wall defining a hollow cavity containing a gas system under pressure having a molecular weight greater than 49, which ball generates a noise upon impact, the improvement which comprises the addition of a small but effective amount to reduce the noise generated by the presence of the gas system to an audible rating of 0, of a solid material having a weight of less than 0.3 grams and shaped to disrupt the spherical symmetry of the inside of the ball.

5. In a pressurized game ball including an elastomeric gas-permeable wall defining a hollow cavity containing a gas system under pressure having a molecular weight greater than 49, which ball generates a noise upon impact, the improvement which comprises the addition of a small but effective amount to reduce the noise generated by the presence of the gas system to an audible rating of 0, of a solid material and shaped to disrupt the spherical symmetry of the inside of the ball.

* * * * *